US007089828B1

(12) United States Patent
Ho

(10) Patent No.: US 7,089,828 B1
(45) Date of Patent: Aug. 15, 2006

(54) RATCHET SCREWDRIVER WITH A QUICK RETRACTABLE POSITIONING JOINT

(75) Inventor: Shih-Chi Ho, Ta-Li (TW)

(73) Assignee: Yeh-Hsing Enterprise Co., Ltd., Ta-Li (TW)

( * ) Notice: Subject to any disclaimer, the term of this patent is extended or adjusted under 35 U.S.C. 154(b) by 0 days.

(21) Appl. No.: 10/898,728

(22) Filed: Jul. 26, 2004

(51) Int. Cl.
*B25B 13/48* (2006.01)

(52) U.S. Cl. ..... 81/60; 81/177.2

(58) Field of Classification Search ..... 81/60, 81/177.2, 177.85; 192/43.1, 43.2
See application file for complete search history.

(56) References Cited

U.S. PATENT DOCUMENTS 1,203,853 A * 11/1916 Contal ..... 81/177.2
1,753,441 A * 4/1930 Morehouse ..... 81/132
2,438,633 A * 3/1948 Condor ..... 403/107
2,592,978 A * 4/1952 Trimboli ..... 81/177.1
2,963,930 A * 12/1960 Clothier et al. ..... 81/177.2
4,102,375 A * 7/1978 Rossini ..... 81/30
4,586,406 A * 5/1986 Howard ..... 81/177.2
4,703,677 A * 11/1987 Rossini ..... 81/471
4,960,015 A * 10/1990 Mathews ..... 81/177.2
5,836,223 A * 11/1998 Lin ..... 81/436
6,148,696 A * 11/2000 Chiang ..... 81/63.1
6,260,452 B1 * 7/2001 Yu ..... 81/177.2
6,622,597 B1 * 9/2003 Chen ..... 81/58.3
6,901,826 B1 * 6/2005 Huang ..... 81/177.2
2004/0173061 A1 * 9/2004 Liou ..... 81/177.85

* cited by examiner

*Primary Examiner*—David B. Thomas
(74) *Attorney, Agent, or Firm*—Egbert Law Offices

(57) ABSTRACT

A ratchet screwdriver apparatus has a main body, a tubular member connected into the hole of the grip of the main body, a retractable element having an end extending through a through hole of the tubular member, and a positioning mechanism cooperatively connecting the tubular member with the retractable element so as to cause the retractable element to be in a fixed position with respect to the tubular member and in freely movable relationship with the tubular member. The positioning mechanism has a pair of half-mould structures, a ball extending through a tapering slot of the tubular member, a single elastic ring extending around the periphery of the first and second half-mould structures and a control ring extending entirely over the elastic ring.

2 Claims, 7 Drawing Sheets

RATCHET SCREWDRIVER WITH A QUICK RETRACTABLE POSITIONING JOINT

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to a ratchet screwdriver, and more particularly to a ratchet screwdriver which is comprised of a quick retractable positioning joint.

BACKGROUND OF THE INVENTION

Ratchet screwdriver is a screwdriver with a design of a switching turning drive device, which enables its joint to turn clockwise or anti-clockwise. This can make the screwdriver constantly positioned on bolts while screwing down or slackening bolts without repeating a turning operation. As for the structure of ratchet screwdriver, the turning drive switching device is usually positioned at the forepart of grip and the restraint joint is extended a fixed distance from the turning drive switching device. However, some shortcomings are learnt in its application. Since the joint distance of ratchet screwdriver is fixed, its application is limited under varied working environments.

Therefore, much is desired in the design of a retractable and convenient joint for a ratchet screwdriver.

BRIEF SUMMARY OF THE INVENTION

The advantages of this invention are as follows:

1. Taking advantage of the retractable joint design, this ratchet screwdriver can extend or shorten its joint to meet the demands of the working environment.
2. This retractable joint consists of a half mold stand, ball, elastic restraint, and controlling outside ring. To fix or extend the joint, it only requires turning clockwise or anti-clockwise the controlling outside ring.

The above examples are detailed description of the technical characteristics of this invention. Those who are familiar with this technology might, on the basis of this invention, modify and adopt this invention. However, such modification and adoption are covered in the patent application of this invention.

DETAILED DESCRIPTION OF THE INVENTION

Figure 1:
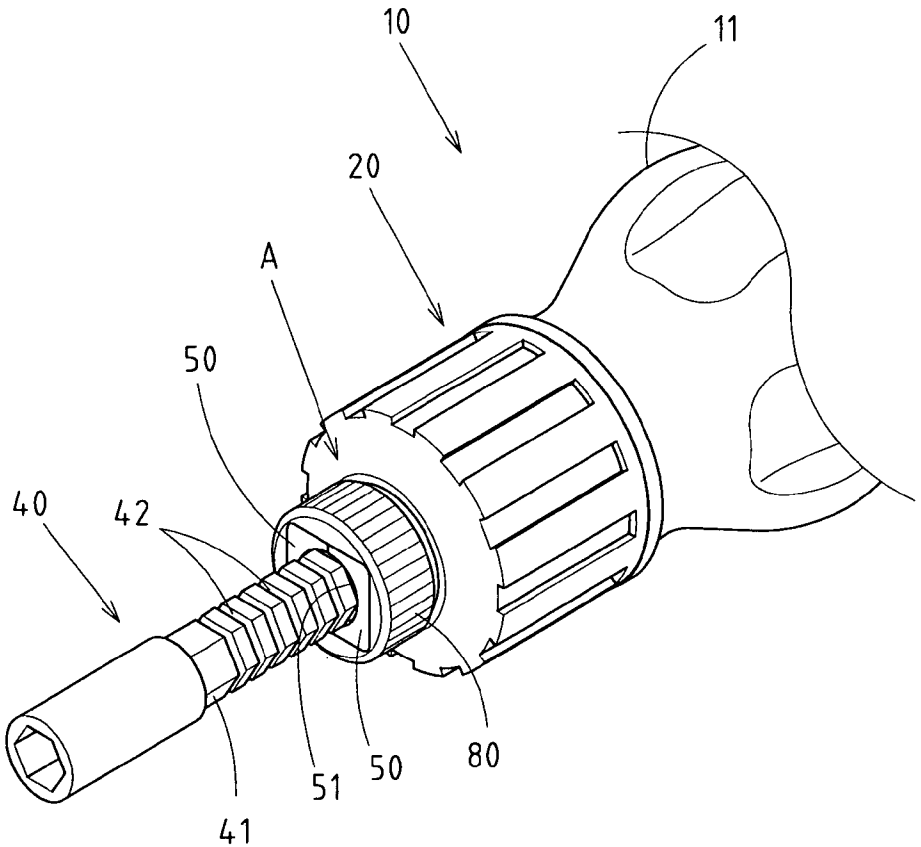
FIG. 1 shows a perspective view of the outer front part of the ratchet screwdriver.
Figure 2:
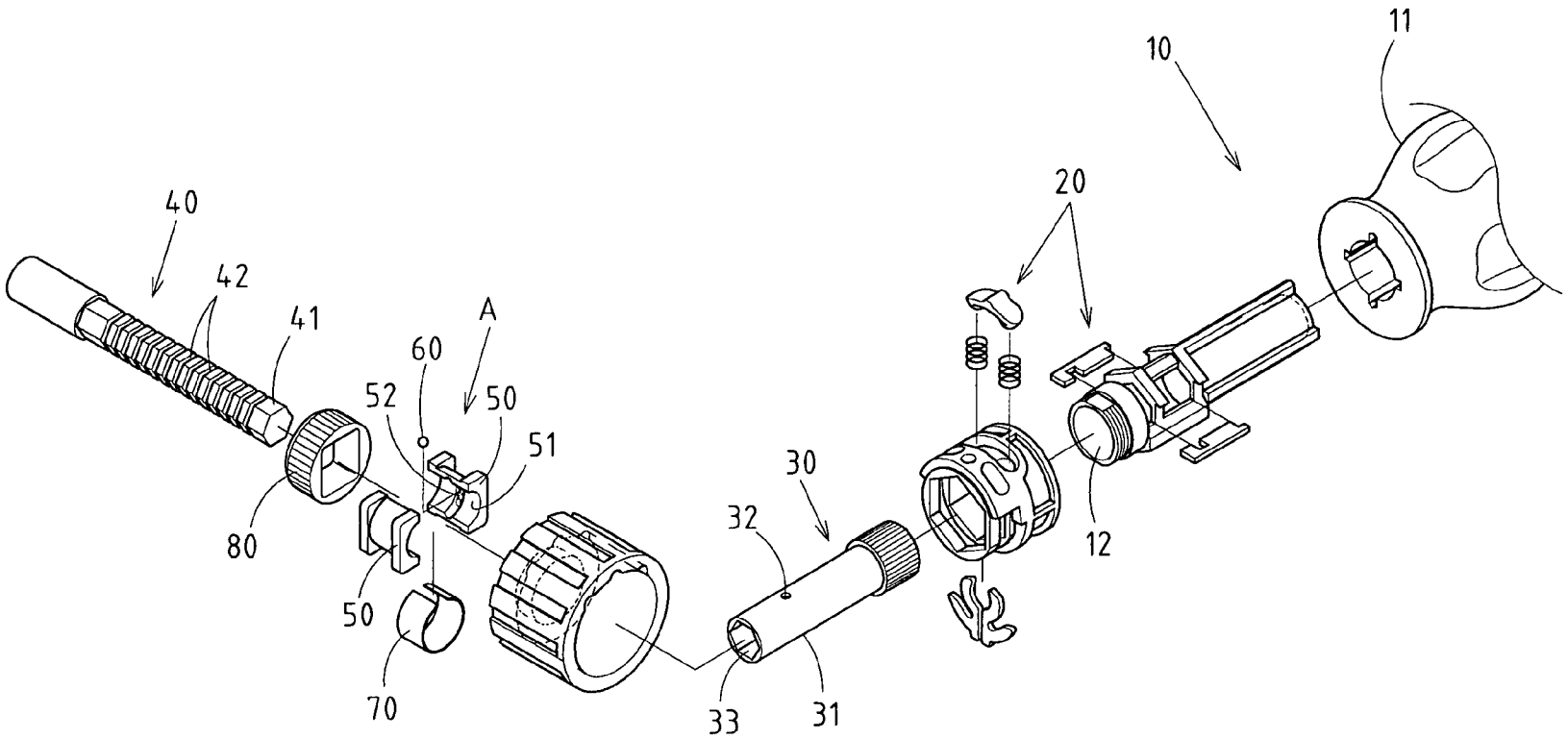
FIG. 2 shows an exploded perspective view of the internal structure of the ratchet screwdriver.

The features and the advantages of the present invention will be more readily understood upon a thoughtful deliberation of the following detailed description of a preferred embodiment of the present invention with reference to the accompanying drawings.

As shown in FIGS. 1–4, there is a ratchet screwdriver embodied in the present invention.

The invention includes a ratchet screwdriver 10, which has a grip 11, whose forepart embodies a drive-switching device 20 that is capable of controlling the drive direction of a shaft-hole stand 30. The structure of this drive-switching device now is common in ratchet screwdriver designing and therefore is not the intended target of this invention. At the forepart of the shaft-hole stand 30, there is a protruding tubule 31 stretching outside of the forepart of the ratchet screwdriver. On one side of the tubule 31 there is a tapering slot 32. Between the shaft-hole stand 30 and the grip 11 there is a through-hole 33.

There is also a retractable joint 40, which has a pole 41 going through above-mentioned shaft-hole stand 30 and the through-hole 33 of the grip 11. This pole 41 works together with the shaft-hole stand 30 to make the turning drive-switching device 20 control the turning action of the retractable joint 40.

The positioning device A of the retractable joint includes two half mould stands 50; whose inside has responding hemi-sphere concave 51 which can hang around the protruding tubule 31 of the shaft-hole stand 30 and move around it. On the deep 521 and shallow 522 parts of the hemi-sphere concave 51 of half mould stand 50, there is an action-transmitting slot 52.

There is a ball 60, which is placed between the tapering slot 32 of above-mentioned protruding tubule 31 and the action-transmitting slot 52 of the half mould stand 50. When the outside of the ball 60 is positioned at the shallow part 522 of the action-transmitting slot 52 of the half mould stand, the inner side of the ball 60 protrudes from the tapering through-slot 32 and reaches the outer perimeter of the pole 41 of the retractable joint 40. If the outside of the ball 60 were positioned at the deep part 521 of the action-transmitting slot 52, the inner side of the ball 60 would be loosely connected with the pole 41.

The device also has an elastic restraint 70 being a C type metal strip. It is placed outside of the perimeter of the two half mould stands 50 and plays the role of elastic positioning.

There is a controlling outside ring 80, which is placed at the perimeter of the two half mould stands 50 and the elastic restraint 70. Its inner ring edge might be set to connect with the perimeter of the two half mould stands 50 to form directional link. This controlling outside ring can be manually turned and drive the two half mould stands 50 to move clockwise and anti-clockwise, which, in turn, controls the position of above-mentioned ball 60 on the deep and shallow parts 521 522 of the action-transmitting slot 52.

The device further includes a pole 41 and shaft-hole stand 30 of the retractable joint 40, both of which can be polygonal such as a six-angle pole and a polygonal hole (such as six-angle hole) to form a directional link and turn synchronously.

Separately distributed necks can be set at the pole 41 of the retractable joint 40 in which the inner side of the ball 60 can be locked and accordingly achieve better positioning.

Drawing on above structure and composition, the action of the retractable joint of ratchet screwdriver of this invention is as follows.

Figure 3:
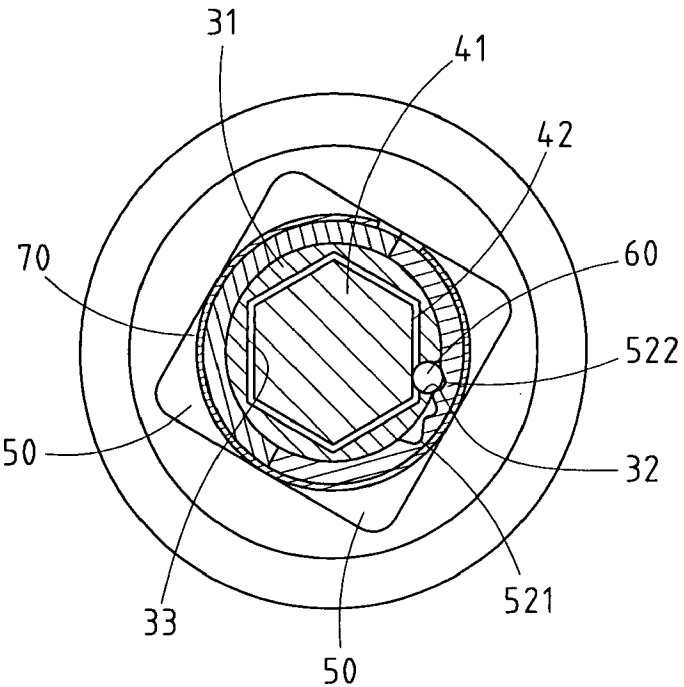
FIG. 3 shows a cross-sectional view of ball wedging part when the retractable connector is at a fixed position.
Figure 5:
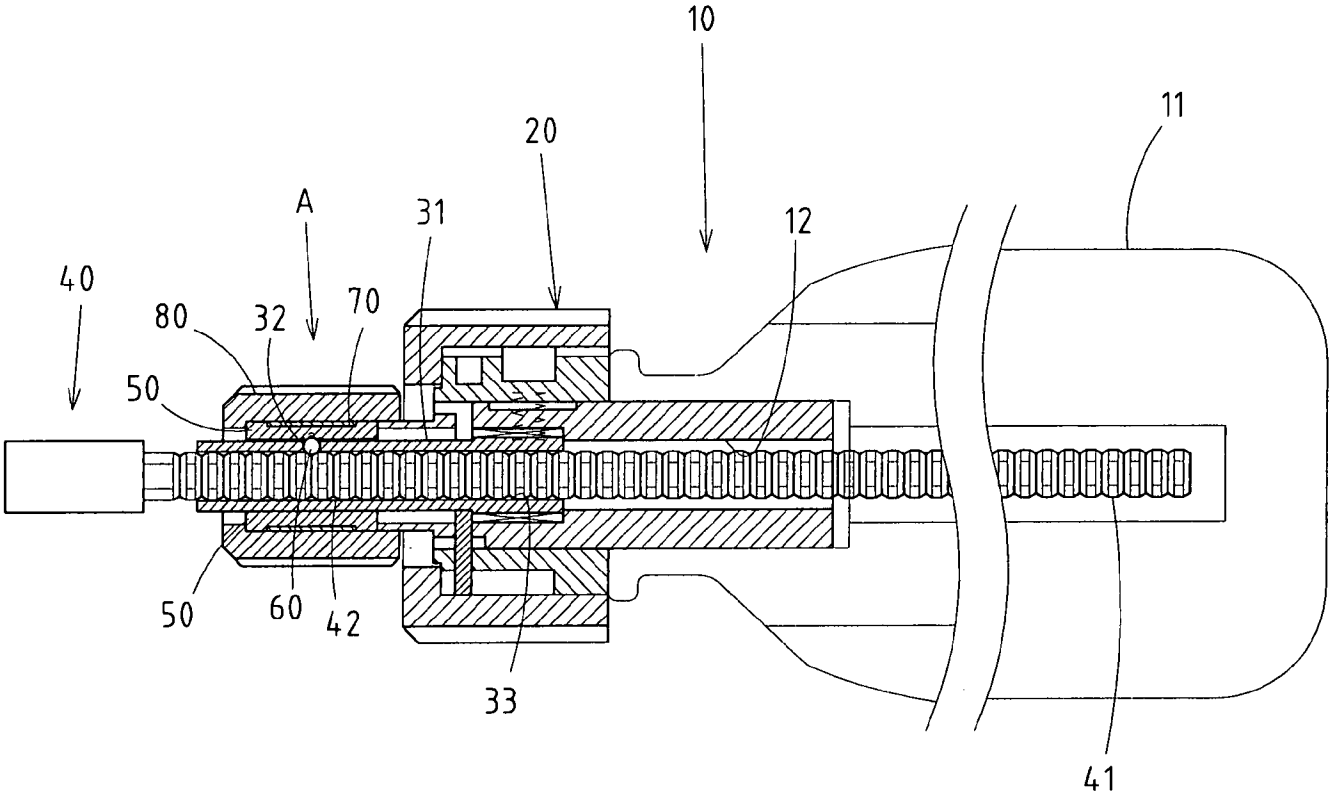
FIG. 5 shows a longitudinal sectional view of internal structure when the retractable connector is at a fixed position.

In this invention, turning anti-clockwise the controlling outside ring 80 to fix or retract the retractable joint 40. As shown in FIGS. 3 and 5, when the outside of the ball 60 is positioned at the shallow part 522 of the action-transmitting slot 52 of the half mould stand, the inner side of the ball 60 would protrude from the tapering through-slot 32 and stick in the neck 42 of the perimeter of the pole 41 of the retractable joint. Therefore the retractable joint 40 is fixed.

Figure 4:
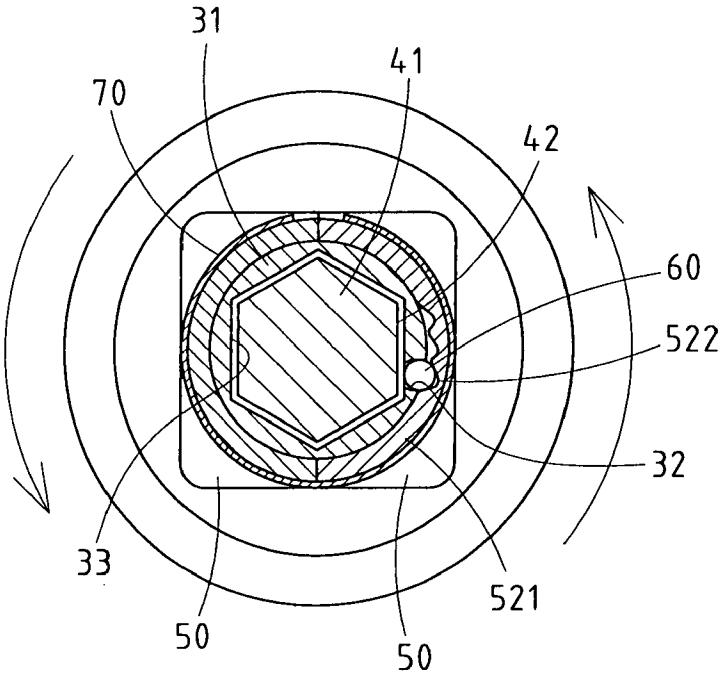
FIG. 4 shows another cross-sectional view of ball wedging part when the retractable connector is at a movable position.
Figure 6:
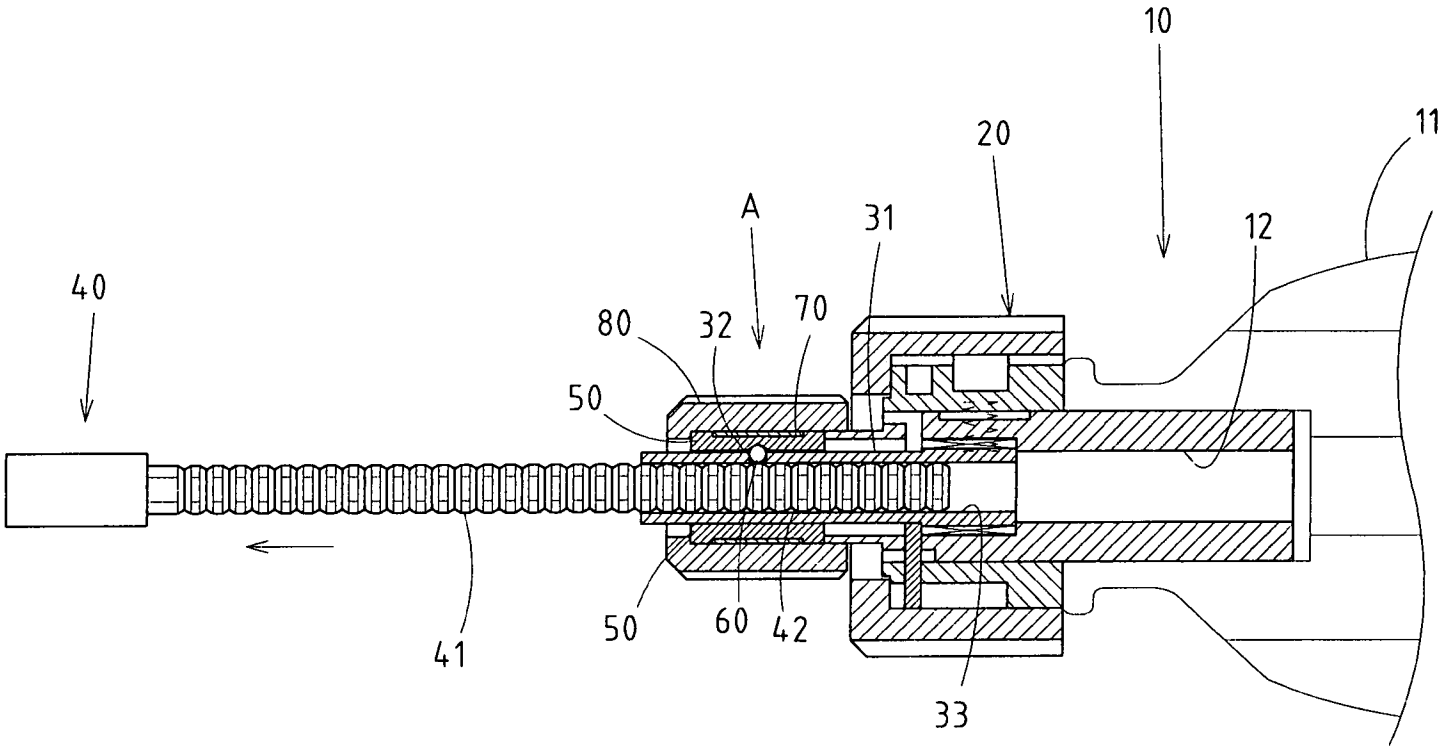
FIG. 6 shows another longitudinal sectional view of internal structure when the retractable connector is at a movable position.

As shown in FIGS. 4 and 6, when the controlling outside ring is turned anti-clockwise 80, the outside of the ball 60 would move against the hemi-sphere concave 51 to make the inner side of the ball 60 positioned at the deep part 521 of the action-transmitting slot 52. In this case, the inner side of the ball 60 would be loosely connected with the pole 41 and the retractable joint 40 can be freely extended to desired length. Then turn the controlling outside ring 80 to fix the retractable joint 40.

Figure 7:
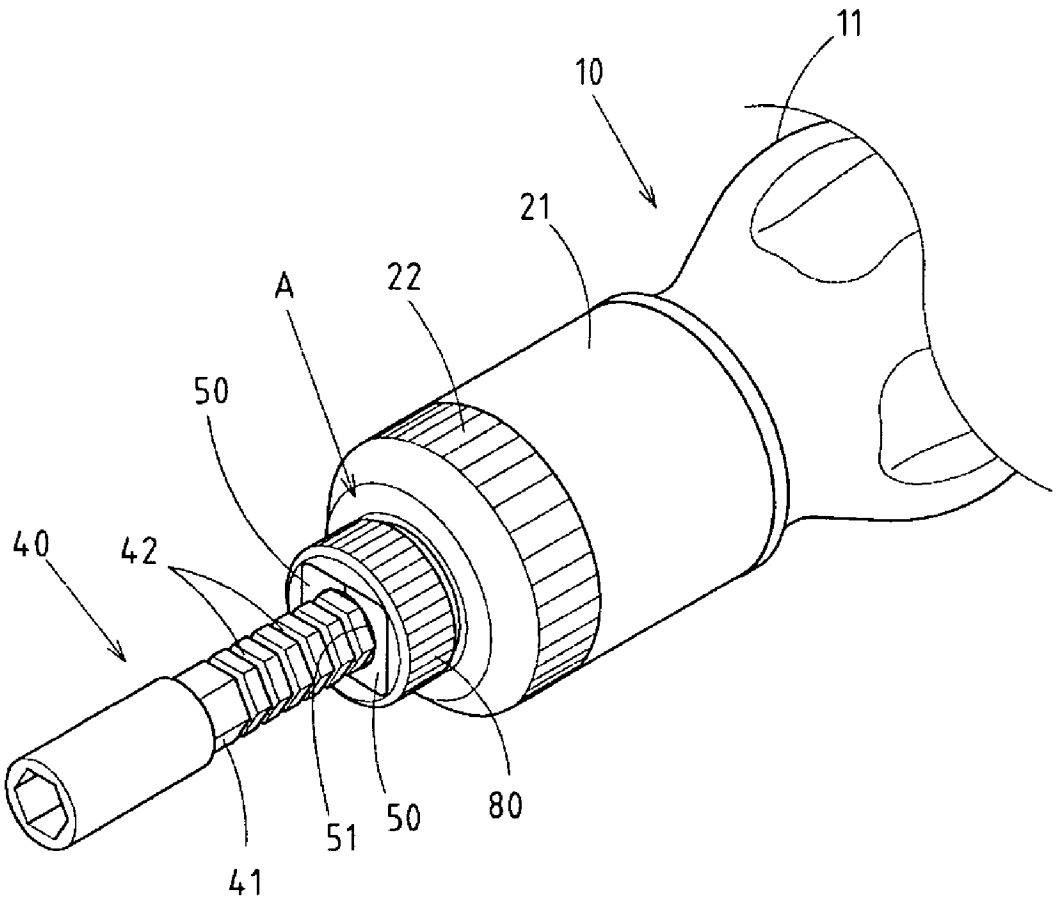
FIG. 7 shows another perspective view of the present invention.
Figure 8:
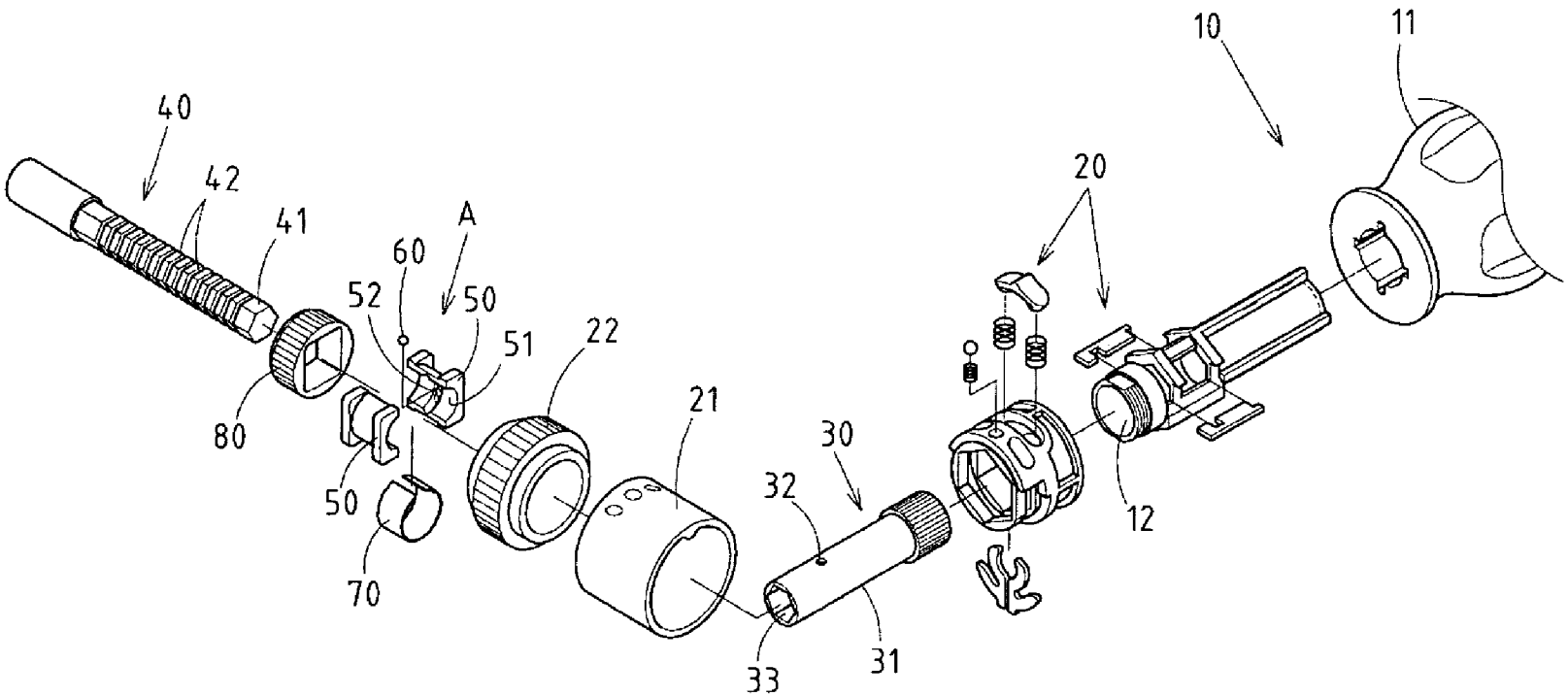
FIG. 8 shows another exploded perspective view of the present invention.

Another example of the drive-switching device 20 of ratchet screwdriver is shown in FIGS. 7 and 8. It differs with that shown in FIGS. 1 and 2 at the fact that the outside of the drive-switching device 20 is made of a tubular body 21 whose forepart is connected with a socket ring 22.

I claim:

1. A ratchet screwdriver apparatus comprising:

a main body having a grip with a hole formed at an end thereof;

a member connected in said hole of said grip, said member having a tubular portion formed thereon so as to extend outwardly of said grip, said tubular portion having a tapering slot extending through a wall thereof, said member having a through hole extending longitudinally therethrough;

a retractable element having an end extending through said through hole of said member; and a positioning mechanism cooperatively connecting said member and said retractable element so as to cause said retractable element to be in a fixed position with respect to said member and in freely movable relation with respect to said member, said positioning mechanism comprising:

a first half-mould structure having a semi-circular concave formed therein;

a second half-mould structure having a semi-circular concave formed therein and facing said concave of said first half-mould structure, said first and second half-mould structures extending around said tubular portion such that said tubular portion is received by the concaves thereof, one of the concaves having an action-transmitting slot formed on a surface thereof facing said tubular portion, said slot having a deep portion and a shallow portion;

a ball extending through said tapering slot of said tubular portion so as to have a portion extending into said action-transmitting slot, said ball being movable between a first position in which said ball contacts said shallow portion of said action-transmitting slot and extends through said tapering slot so as to urge against a surface of said member and a second position in which said ball contacts said deep portion of said action-transmitting slot so as to be free of a surface of said member;

a single elastic ring extending around a periphery of said first and second half-mould structures such that said first and second half-mould structures are resiliently mounted in relation to said tubular portion; and a control ring extending entirely over and around said single elastic ring, said control ring being rotatably mounted thereover so as to rotate said first and second half-mould structures such that said ball is movable between said first and second positions.

2. The apparatus of claim 1, said surface of said member having a polygonal configuration.

* * * * *